US005171003A

United States Patent [19]

Kull

[11] Patent Number: 5,171,003

[45] Date of Patent: Dec. 15, 1992

[54] INSTANT GRIP SINGLE ACTION CLAMP

[76] Inventor: Andrew Kull, 157 Hughes Pl., Albertson, N.Y. 11507

[21] Appl. No.: 854,078

[22] Filed: Mar. 19, 1992

[51] Int. Cl.[5] ..... B66F 3/00

[52] U.S. Cl. ..... 269/97; 269/166; 269/329

[58] Field of Search ..... 269/6, 166–171, 269/97, 98, 41, 277, 329, 147; 83/761, 762, 763

[56] References Cited

U.S. PATENT DOCUMENTS

| | | | |
|---|---|---|---|
| 768,496 | 8/1904 | Whitten | 269/165 |
| 4,291,868 | 9/1981 | Giles | 269/170 |
| 4,437,375 | 3/1984 | Elmore et al. | 269/41 |
| 4,874,155 | 10/1989 | Goul | 269/6 |
| 4,875,667 | 10/1989 | Schafer | 269/97 |
| 5,009,134 | 4/1991 | Sorensen et al. | 269/166 |

*Primary Examiner*—Robert C. Watson
*Attorney, Agent, or Firm*—Burton S. Heiko

[57] ABSTRACT

A quick release single arm clamp used temporarily on a miter box to securely clamp a workpiece against the inner side where the invention is placed on one edge of a side of the miter box to securely clamp a workpiece against the inner side where the invention is placed on one edge of a side of the miter box by means of a bracket with an axle fitted with a knob to be either pushed in or pulled out at one end with the other end adapted to fit the cavity of the miter box with a space bar at its end longer than it is wide which when the axle is pushed in holds the workpiece in tension by a spring and lever combination through which the axle is threaded which tension can be released by a lever releasing the tension.

8 Claims, 2 Drawing Sheets

INSTANT GRIP SINGLE ACTION CLAMP

BACKGROUND OF THE INVENTION

1) Field of the invention

The field of this invention concerns the holding of a workpiece tight against the inside of a mitre box without slipping or sliding allowing the workpiece to be cut at the desired angle and size. Persons who use mitre boxes find it difficult to hold the workpiece steady while cutting. Most often the workpiece is forced against the inside part of one side by using only the person's hand. Many times there are slips and injuries due to this procedure.

2) Description of the prior art

To forestall any injuries and prevent slipping and sliding 2 wedges are often slipped into the cavity of the mitre box and sliding against each other force the workpiece tight against the other side allowing the cutting to be done without injury. The wedges themselves may also be expendable. Sometimes at the edge of the mitre box clamps are used. Sometimes clamps are used that are fastened down permanently at one end and pressure is directed at the other end or arm either downward or horizontally. Usually, some cam releases or tightens the clamp.

Although there are many types of clamps most are highly specialized. U.S. Pat. No. 4,794,675 is an adjustable clamp with slot and guide. U.S. Pat. No. 4,794,676 is a clamping device especially for printed circuit boards. U.S. Pat. No. 4,848,758 is a jewelers clamp. U.S. Pat. No. 4,854,206 is an adjustable tool supporting device. And U.S. Pat. No. 4,875,399 is a mitre box attachment for cutting crown mouldings and the like.

This is the first time, however, that a clamp is used directly insider the mitre box which clamp is easily and temporarily affixed or removed from the mitre box.

BRIEF SUMMARY OF THE INVENTION

An instant grip single action clamp used with a mitre box fitting over the edge of one side of the mitre box and an axle which is adapted to the cavity of the mitre box with one end having a space bar longer than it is wide and the other end having a knob to push in or pull out and when pushed in forces a workpiece tightly against the inside of a side of the mitre box allowing the cutting of the workpiece without slipping or sliding.

It is the principal object of the present invention to provide a clamp holding the workpiece tight without slipping or sliding and exposing the user to injury.

It is another object of this invention to provide a single arm clamp that is spring loaded to keep the workpiece tight against the far inside of the mitre box.

It is another object of this invention to provide a device that can be used temporarily on mitre boxes and can be easily put on or taken off.

The best mode of this invention is a device fitting on the edge of one side of the mitre board by a bracket or by other fastening means with an axle with a knob at the outer end and at the inner end of the axle adapted to fit into the cavity of the mitre box a space bar longer than it is wide pushing a workpiece tight against the far side of the mitre board when the knob is pushed in with a lever and spring mounted around the axle immobilizing the axle when pushed in and when the lever is released releasing the tension in the axle.

DETAILED DESCRIPTION OF THE INVENTION

Figure 1:
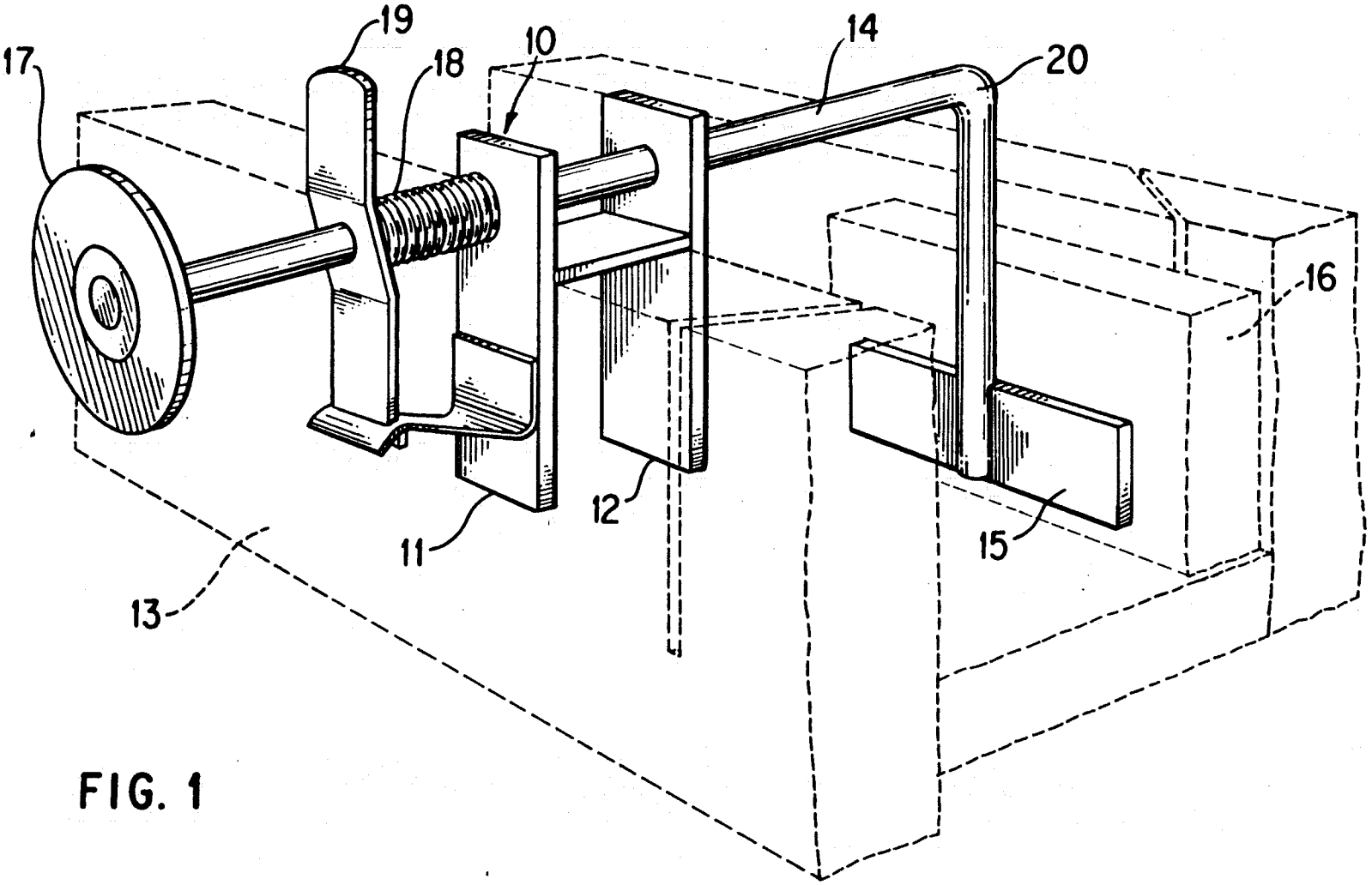
FIG. 1 is an isometric view of my invention shown sitting on the edge of a mitre box.
Figure 3:
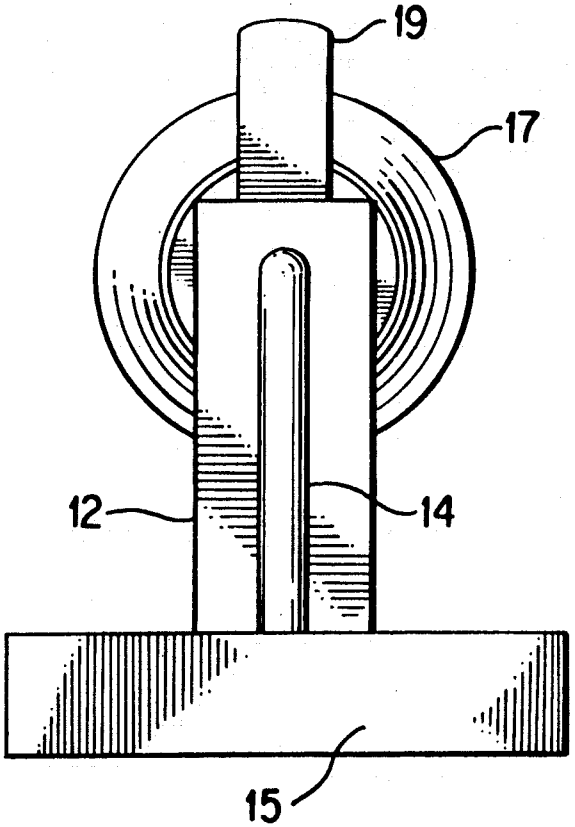
Figure 2:
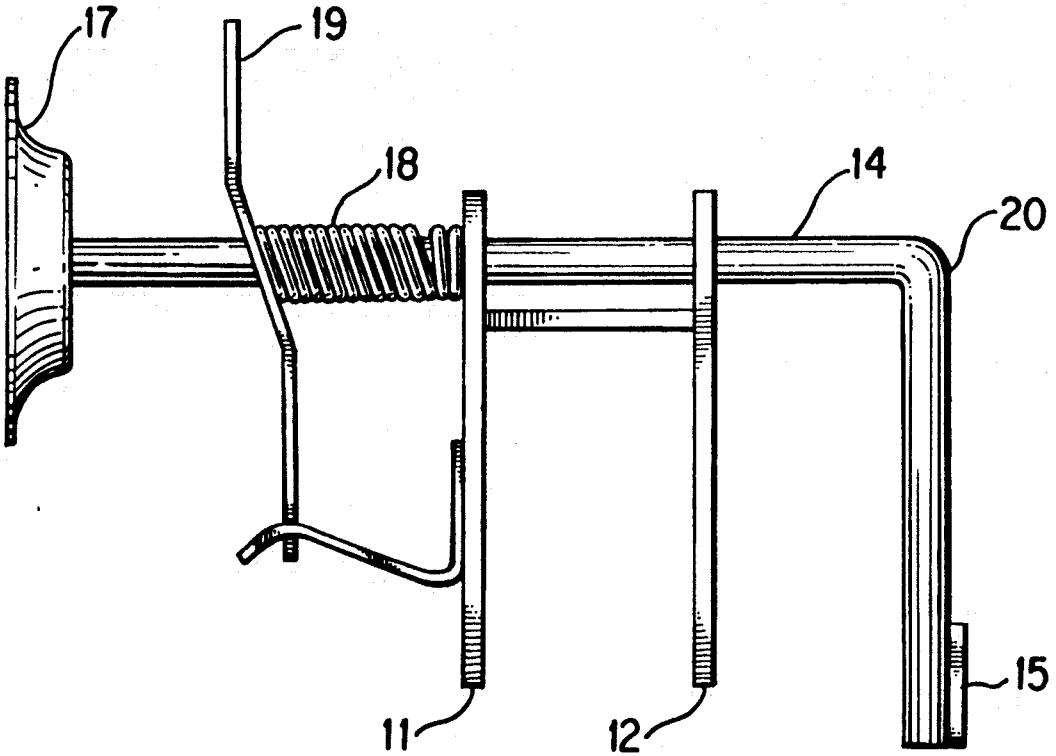
FIG. 2 is a side view of my invention, and, FIG. 3 is an end view of the same invention.

While the invention will be described in connection with the preferred embodiments, it will be understood that it is not intended to limit this invention to these embodiments. On the contrary, it is intended to cover all alternatives, modifications, and equivalents as may be included within the spirit and scope of the invention as defined by the appended claims.

Ten, 10, is the entire unit of the instant grip single action clamp in its entirety. The arms of the bracket, 11, and 12, fit over one side of the mitre box, 13, with the axle, 14, attached at one end to a flat bar surface, 15, pushing the workpiece, 16, against the side of the mitre box with the knob, 17, at the other end of the axle which when pushed in, engages the lever, 19, which holds the other end of the axle with the flattened space bar, 15, firmly in tension. To release the tension, there is a lever, 19, adjacent to the spring, 18, which when pulled releases the spring releasing the tension and releasing the workpiece. The single armed axle of the clamp has a bend in it, 20, adapted to enter the cavity of the mitre box ending with a space bar, 15, longer than it is wide allowing the axle to force the workpiece up against the other side of the mitre box keeping it immobilized.

When the knob is pushed in the lever catches the axle and holds it tight placing the flattened end within the cavity of the mitre box in tension. The lever is adjacent to the spring and when released releases the tension on the space bar.

This invention can be used on any tool or jig but is principally and preferably used with a mitre box. Other means besides a bracket, 11 and 12, could be used. For example, a small clamp could be used temporarily fastening the invention to the side of the mitre box. Or a more permanent clamp could be used affixing this invention to the mitre box. Any kind of knob could be used that allows the axle to be pushed in with the lever exerting the tension. It could be flat or ornamental as long as it allows a simple and easy push or pull to effect its result. The space bar could be shaped differently provided it exerts maximum push against the workpiece. It would have to be longer than wide to keep the workpiece from slipping or sliding.

When the axle is pushed in the lever and spring act together and when the lever is pulled out the tension is released. Since both the lever and spring are around the axle they keep the force exerted in tension or released from tension. It is even conceivable that this device could be used on only one side with a clamp or bracket fitting over an edge and a lever, cam and spring being tightened against the workpiece sitting on the same side. In this particular case the lever would have to release a cam further releasing a spring or if used without a spring by releasing the cam also releasing the workpiece. But for greater stability and safety the present invention is preferred.

While the invention was described in terms of the preferred embodiments, it will be understood that this invention is not limited to just these embodiments. It is intended to cover all alternatives, modifications and equivalents embraced within the spirit and scope of this invention.

I claim:

1. An instant grip single action clamp for use in holding a workpiece securely inside a mitre box wherein the invention comprises:

a) a bracket to hold a clamp to a side of a mitre box, b) through which bracket a rod is placed with an outside end having a knob allowing the rod to be pushed in with an inside end adapted to fit into the space of a mitre box having a bar at the other end longer than it is wide arranged so that when the rod is pushed in it forces a workpiece against the far inner side of the mitre box c) with the rod sliding through an opening in a lever and an adjacent spring which when the rod is pushed in holds and immobilizes the rod and forces the workpiece tight against the other side of the mitre box allowing the workpiece to be cut at the desired angle and size, and d) which rod can be released from tension by pushing the lever releasing the tension.

2. An instant grip single action clamp comprising a combination clamp and bracket for use in a mitre box wherein the invention comprises a means for holding the clamp to the mitre box at the edge of one side of the mitre box, a long rod with one end having means for pushing in the rod which slidably enters openings in a lever and an adjacent spring, with the other end adapted to fit the cavity of the mitre box ending with means for a space bar which when pushed in immobilizes a workpiece against the inner side of the mitre box which tension can be released by pushing the lever adjacent to the spring through both of which the rod is passed allowing the workpiece to be cut at the angle and size desired.

3. A hand tool primarily for use in a mitre box comprising: a jaw; a slide bar, said jaw being mounted on one end of said slide bar, said slide bar being movable; support means for supporting said slide bar while anchoring the tool to the mitre box; drive means for advancing said slide bar against a workpiece fitting against the far inside wall of the mitre box; a braking lever and spring normally engaging said slide bar said braking lever and spring when engaging said slide bar preventing motion of said slide bar and jaw away from the workpiece, said braking lever having an engaging portion attached to said support means; said movable slide bar with jaw having a drive means mounted at the opposite end of the jaw allowing the slide bar to be pushed in against the workpiece and held by the braking lever and spring preventing backward motion of the slide bar which braking means can be released by pushing the braking lever releasing the spring releasing the slide bar allowing it to freely move backward.

4. A hand tool as claimed in claim 3 wherein said support means for supporting said slide bar comprises a bracket fitting over the edge of one side of a mitre box.

5. A hand tool as claimed in claim 3 wherein said drive means for advancing said slide bar against a workpiece comprises a knob at the outer end of said slide bar allowing the said slide bar to be pushed in with a single action.

6. A hand tool as clamped in claim 3 wherein said braking lever comprises an inner portion fastened to a bracket with the outer engaging portion which when pushed disengages the slide bar releasing the workpiece.

7. A hand tool as claimed in claim 3 wherein a single movable jaw when tightened secures the workpiece to the mitre box.

8. A hand tool as claimed in claim 3 wherein the braking lever and spring further comprises an outer portion and spring through which the slide bar is passed which when pushed in catches and holds the said slide bar and is released when the outer portion of the braking lever is pushed.

* * * * *